US010837135B2

(12) United States Patent
Hendrickson et al.

(10) Patent No.: US 10,837,135 B2
(45) Date of Patent: Nov. 17, 2020

(54) DISPENSING TREATING CHEMISTRY IN A LAUNDRY TREATING APPLIANCE

(71) Applicant: WHIRLPOOL CORPORATION, Benton Harbor, MI (US)

(72) Inventors: Michael S. Hendrickson, Owasso, OK (US); Janice M. Kaeding, Lawrence, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/522,927

(22) Filed: Jul. 26, 2019

(65) Prior Publication Data

US 2019/0382939 A1 Dec. 19, 2019

Related U.S. Application Data

(63) Continuation of application No. 15/867,018, filed on Jan. 10, 2018, now Pat. No. 10,385,499, which is a continuation of application No. 15/350,533, filed on Nov. 14, 2016, now Pat. No. 9,890,493, which is a continuation of application No. 13/267,218, filed on Oct. 6, 2011, now Pat. No. 9,534,336.

(51) Int. Cl.

| | |
|---|---|
| ***D06F 39/00*** | (2020.01) |
| ***D06F 39/08*** | (2006.01) |
| ***D06F 39/02*** | (2006.01) |
| ***D06F 35/00*** | (2006.01) |
| ***D06F 34/18*** | (2020.01) |

(52) U.S. Cl.

CPC ..... *D06F 34/18* (2020.02); *D06F 35/005* (2013.01); *D06F 39/02* (2013.01); *D06F 39/088* (2013.01)

(58) Field of Classification Search

CPC ..... D06F 39/088; D06F 35/005; D06F 39/02; D06F 34/18

See application file for complete search history.

(56) References Cited

U.S. PATENT DOCUMENTS

| | | | |
|---|---|---|---|
| 2,929,234 | A | 3/1960 | Castricone |
| 3,257,030 | A | 6/1966 | Vaughn et al. |
| 3,736,773 | A | 6/1973 | Waugh |
| 4,845,965 | A | 7/1989 | Copeland et al. |
| 4,956,887 | A | 9/1990 | Hakulinen |
| 4,998,850 | A | 3/1991 | Crowell |
| 5,253,379 | A | 10/1993 | Dusamos et al. |
| 5,359,744 | A | 11/1994 | Kimball et al. |

(Continued)

FOREIGN PATENT DOCUMENTS

| | | | |
|---|---|---|---|
| CN | 201221027 | Y | 4/2009 |
| DE | 10303866 | A1 | 8/2004 |

(Continued)

OTHER PUBLICATIONS

German Search Report for Counterpart DE102012107219, dated Jan. 17, 2013.

*Primary Examiner* — Benjamin L Osterhout
(74) *Attorney, Agent, or Firm* — McGarry Bair PC

(57) ABSTRACT

An appliance and method of operating a laundry treating appliance having a treating chamber for receiving laundry for treatment and a dispensing system having a dispensing pump for dispensing a treating chemistry for use in treating the laundry, the method comprising determining a soil level of laundry in the treating chamber and determining a dispensing parameter based on the determined soil level.

20 Claims, 5 Drawing Sheets

(56) References Cited

U.S. PATENT DOCUMENTS

| | | | |
|---|---|---|---|
| 5,389,344 | A | 2/1995 | Copeland et al. |
| 5,504,954 | A | 4/1996 | Joo et al. |
| 5,826,749 | A | 10/1998 | Howland et al. |
| 5,842,599 | A | 12/1998 | Douma et al. |
| 6,557,732 | B2 | 5/2003 | Van Rompuy et al. |
| 6,659,114 | B2 | 12/2003 | Bigott |
| 2004/0172770 | A1 | 9/2004 | Heo et al. |
| 2006/0272359 | A1 | 12/2006 | Kang |
| 2007/0261177 | A1 | 11/2007 | Risen et al. |
| 2008/0276655 | A1 | 11/2008 | Luckman et al. |
| 2008/0276965 | A1 | 11/2008 | Aykroyd et al. |
| 2009/0057341 | A1 | 3/2009 | Girard et al. |
| 2009/0095029 | A1 | 4/2009 | Gelinas |
| 2009/0293923 | A1 | 12/2009 | Buogo et al. |
| 2010/0000022 | A1 | 1/2010 | Hendrickson et al. |
| 2010/0000024 | A1 | 1/2010 | Hendrickson et al. |
| 2010/0000264 | A1 | 1/2010 | Luckman et al. |
| 2010/0000573 | A1 | 1/2010 | Hendrickson et al. |
| 2010/0000581 | A1 | 1/2010 | Doyle et al. |
| 2010/0000586 | A1 | 1/2010 | Hendrickson |
| 2010/0154131 | A1 | 6/2010 | Paul et al. |
| 2010/0212700 | A1 | 8/2010 | Wattley et al. |
| 2010/0236000 | A1 | 9/2010 | Kim et al. |
| 2010/0287709 | A1 | 11/2010 | Doyle et al. |
| 2011/0000511 | A1 | 1/2011 | Mersch et al. |
| 2012/0266389 | A1 | 10/2012 | Ihne et al. |
| 2012/0311794 | A1 | 12/2012 | Hettinger et al. |

FOREIGN PATENT DOCUMENTS

| | | | |
|---|---|---|---|
| EP | 0864684 | A1 | 9/1998 |
| EP | 1245180 | A2 | 10/2002 |
| GB | 590899 | | 7/1947 |

DISPENSING TREATING CHEMISTRY IN A LAUNDRY TREATING APPLIANCE

CROSS-REFERENCE TO RELATED APPLICATIONS

This application is a continuation of U.S. patent application Ser. No. 15/867,018, filed Jan. 10, 2018, now U.S. Pat. No. 10,385,499, issued Aug. 20, 2019, which is a continuation of U.S. patent application Ser. No. 15/350,533, filed Nov. 14, 2016, now U.S. Pat. No. 9,890,493, issued Feb. 13, 2018, which is a continuation of U.S. patent application Ser. No. 13/267,218, filed Oct. 6, 2011, now U.S. Pat. No. 9,534,336, issued Jan. 3, 2017, all of which are incorporated herein by reference in their entirety.

BACKGROUND

Laundry treating appliances, such as clothes washers, which include a treating chamber for receiving a laundry load, may implement a cycle of operation to treat the laundry load in the treating chamber. Laundry treating appliances are often provided with a dispensing system for automatically dispensing one or more treating chemistries to the treating chamber as part of the treatment of the laundry during a cycle of operation. Typically a dispenser is configured to dose a treating chemistry, such as a detergent, at a predetermined time during the cycle. For example, detergents are completely dispensed at the beginning of a wash phase of the cycle of operation.

BRIEF SUMMARY

An aspect of the present disclosure relates to a method of operating a laundry treating appliance having a treating chamber for receiving laundry for treatment and a dispensing system having a dispensing pump for dispensing a treating chemistry for use in treating the laundry, the method comprising determining a soil level of laundry in the treating chamber, determining a dispensing parameter based on the determined soil level and wherein the dispensing parameter is defined by one or more of a delivery rate of the treating chemistry, a dilution rate of the treating chemistry, a flow rate of a water supply, a flow rate of a dispensing pump, or a length of a dispensing interval.

Another aspect of the present disclosure relates to laundry treating appliance, comprising a treating chamber configured for receiving laundry for treatment, a dispensing system having a dispensing pump for dispensing a treating chemistry for use in treating the laundry and a controller configured to determine a soil level of laundry in the treating chamber, determine a dispensing parameter based on the determined soil level wherein the dispensing parameter is defined by one or more of a delivery rate of the treating chemistry, a dilution rate of the treating chemistry, a flow rate of a water supply, a flow rate of a dispensing pump, or a length of a dispensing interval and operate the dispensing system in accordance with the determined dispensing parameter.

DETAILED DESCRIPTION

Figure 1:
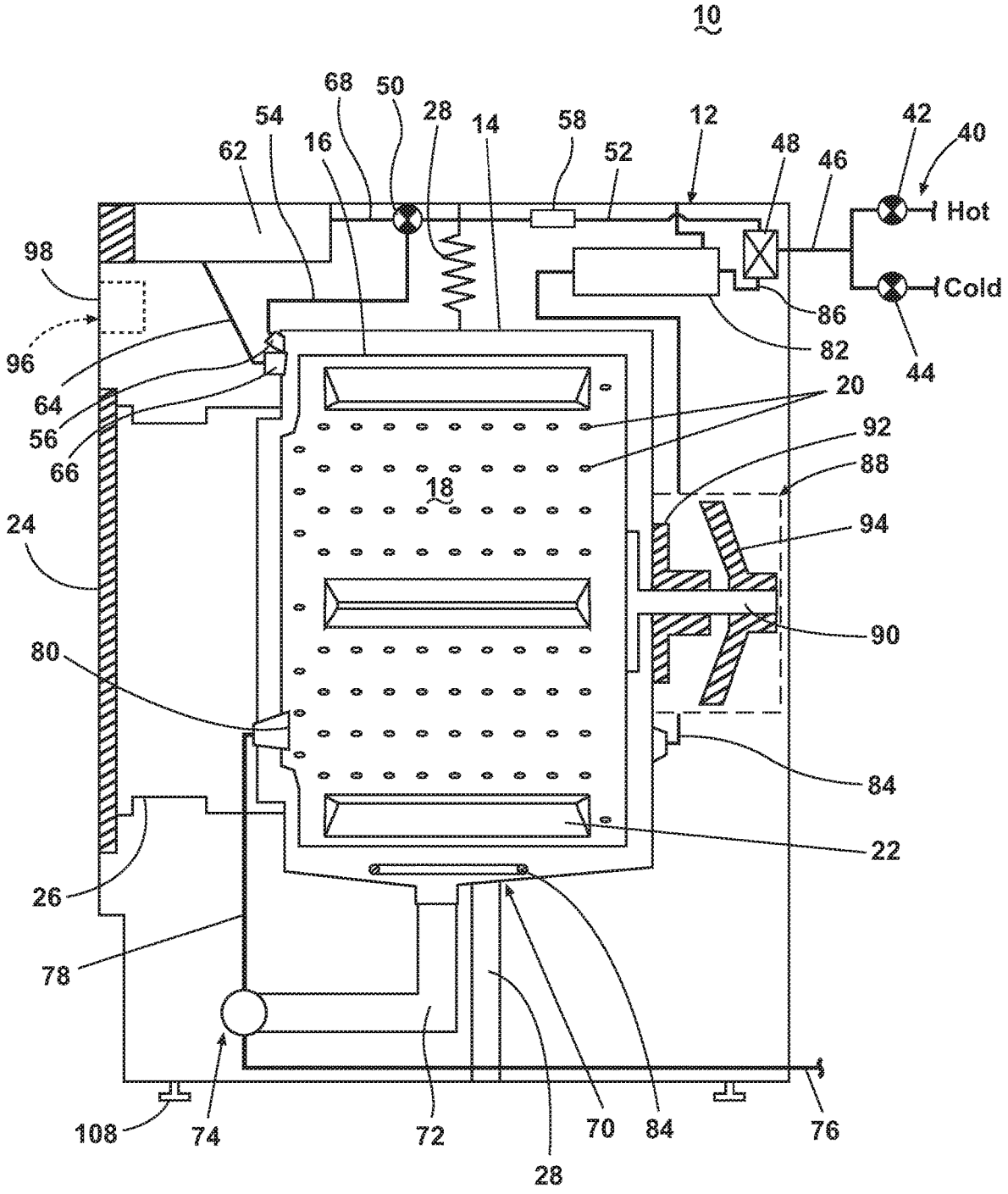
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance 10 may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The supply conduit 52 may be provided with a flow meter 58, which may be configured to provide an output representative of the flow of water through the flow meter 58.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single and bulk dispenser. Non-limiting examples of suitable dispensers are disclosed in U.S. Pub. No. 2010/0000022 to Hendrickson et al., filed Jul. 1, 2008, now U.S. Pat. No. 8,196,441, issued Jun. 12, 2012, entitled "Household Cleaning Appliance with a Dispensing System Operable Between a Single Use Dispensing System and a Bulk Dispensing System," U.S. Pub. No. 2010/0000024 to Hendrickson et al., filed Jul. 1, 2008, now U.S. Pat. No. 8,388,695, issued Mar. 5, 2013, entitled "Apparatus and Method for Controlling Laundering Cycle by Sensing Wash Aid Concentration," U.S. Pub. No. 2010/0000573 to Hendrickson et al., filed Jul. 1, 2008, now U.S. Pat. No. 8,397,328, issued Mar. 19, 2013, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pub. No. 2010/0000586 to Hendrickson, filed Jun. 23, 2009, now U.S. Pat. No. 8,397,544, issued Mar. 19, 2013, entitled "Household Cleaning Appliance with a Single Water Flow Path for Both Non-Bulk and Bulk Dispensing," and application Ser. No. 13/093,132, filed Apr. 25, 2011, now U.S. Pat. No. 8,438,881, issued May 14, 2013, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 84. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the drum 16 through a drive shaft 90 to rotate the drum 14 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

Figure 2:
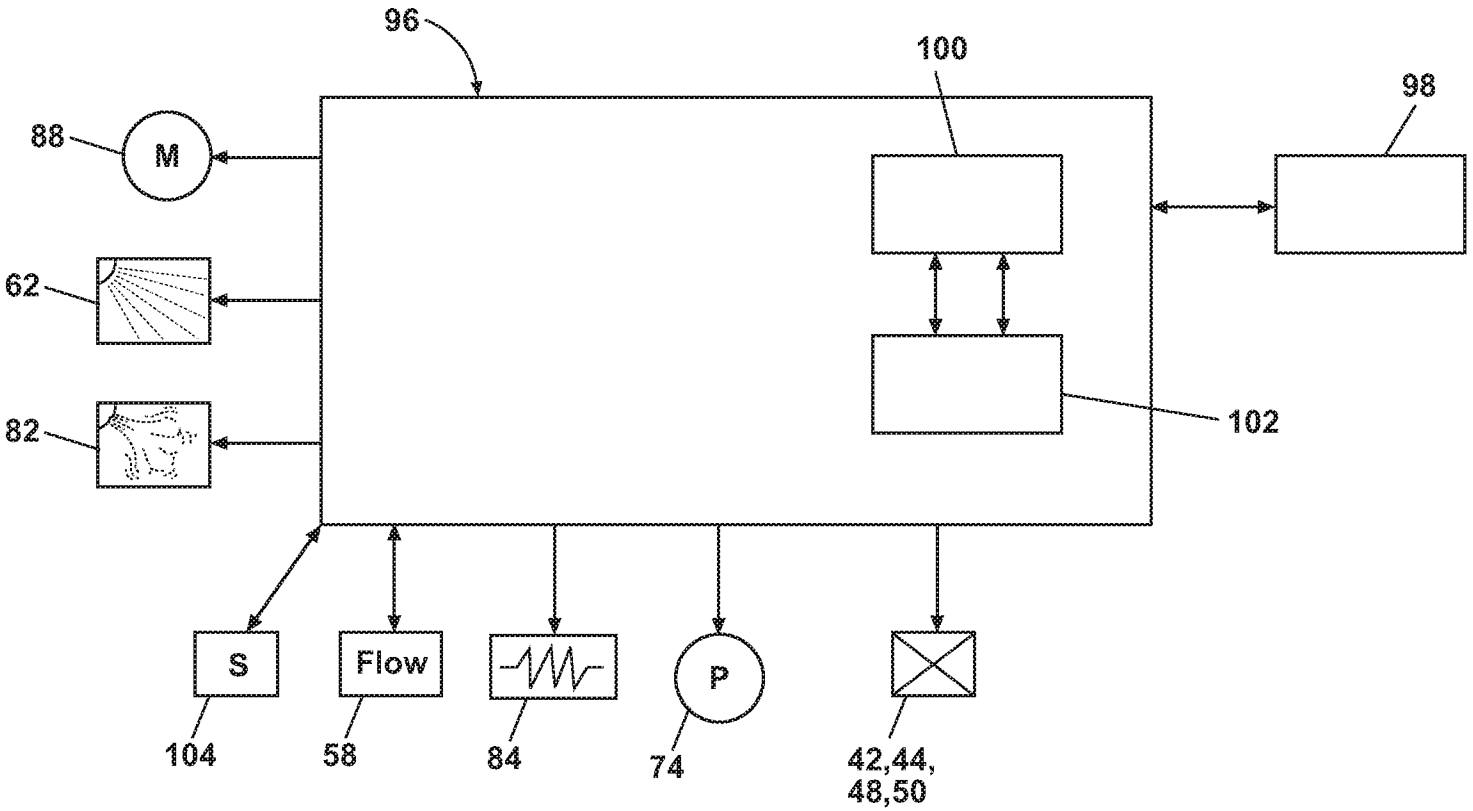
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82, the sump heater 84, the valves 42, 44, diverter mechanisms 48, 50 and the flow meter 58 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

In one example, one or more load amount sensors 106 may also be included in the washing machine 10 and may be positioned in any suitable location for detecting the amount of laundry, either quantitative (inertia, mass, weight, etc.) or qualitative (small, medium, large, etc.) within the treating chamber 18. By way of non-limiting example, it is contemplated that the amount of laundry in the treating chamber may be determined based on the weight of the laundry and/or the volume of laundry in the treating chamber. Thus, the one or more load amount sensors 106 may output a signal indicative of either the weight of the laundry load in the treating chamber 18 or the volume of the laundry load in the treating chamber 18.

The one or more load amount sensors 106 may be any suitable type of sensor capable of measuring the weight or volume of laundry in the treating chamber 18. Non-limiting examples of load amount sensors 106 for measuring the weight of the laundry may include load volume, pressure, or force transducers which may include, for example, load cells and strain gauges. It has been contemplated that the one or more such sensors 106 may be operably coupled to the suspension system 28 to sense the weight borne by the suspension system 28. The weight borne by the suspension system 28 correlates to the weight of the laundry loaded into the treating chamber 18 such that the sensor 106 may indicate the weight of the laundry loaded in the treating chamber 18. In the case of a suitable sensor 106 for determining volume it is contemplated that an IR or optical based sensor may be used to determine the volume of laundry located in the treating chamber 18.

Alternatively, it has been contemplated that the washing machine 10 may have one or more pairs of feet 108 extending from the cabinet 12 and supporting the cabinet 12 on the floor and that a weight sensor (not shown) may be operably coupled to at least one of the feet 108 to sense the weight borne by that foot 108, which correlates to the weight of the laundry loaded into the treating chamber 18. In another example, the amount of laundry within the treating chamber 18 may be determined based on motor sensor output, such as output from a motor torque sensor. It will be understood that the details of the load amount sensors are not germane to the embodiments of the invention and that any suitable method and sensors may be used to determine the amount of laundry.

Figure 3:
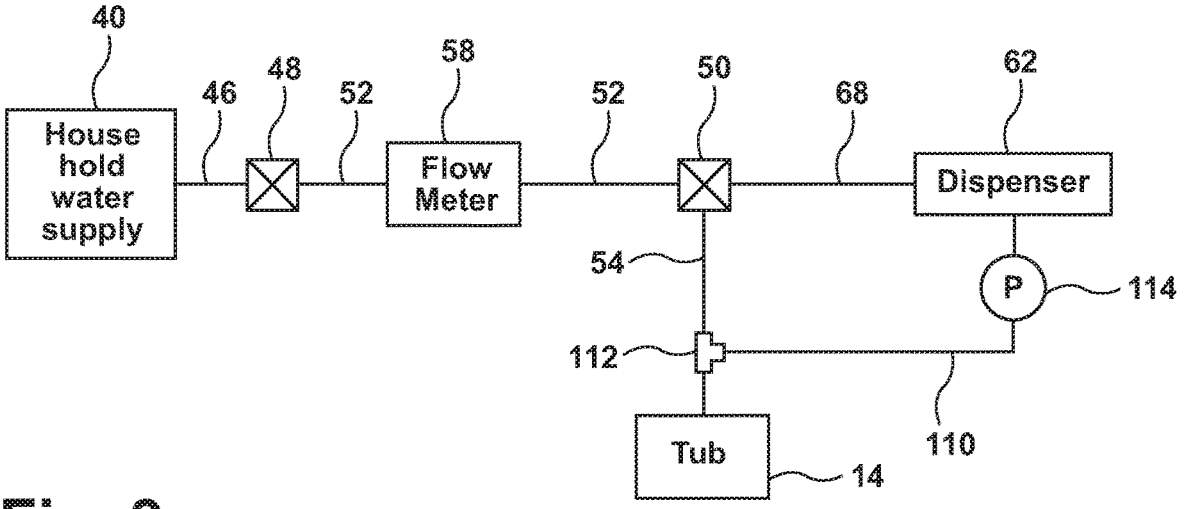
FIG. 3 is a schematic of a dispensing system for use with the laundry treating appliance of FIG. 1 according to a second embodiment of the invention.
Figure 4:
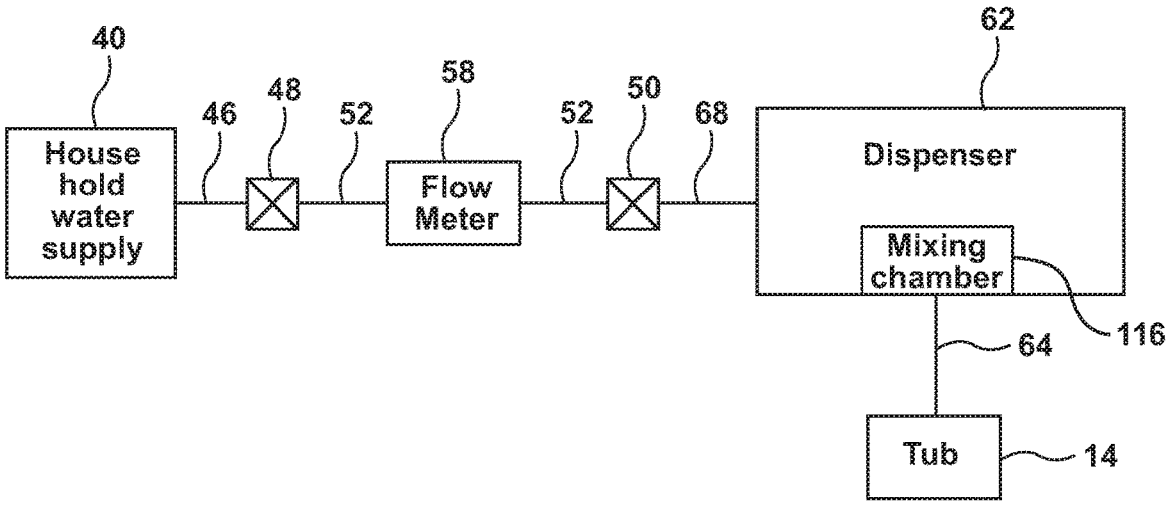
FIG. 4 is a schematic of a dispensing system for use with the laundry treating appliance of FIG. 1 according to a third embodiment of the invention.

FIGS. 3 and 4 schematically illustrate embodiments of the dispensing system of the washing machine 10 for use in supplying treating chemistry to the treatment chamber 18 according to the embodiments of the methods described below. The embodiments illustrate in FIGS. 3 and 4 may be used to dispense a treating chemistry to the treatment chamber 18 during a cycle of operation to minimize the amount of water and/or treating chemistry used without negatively impacting the treatment performance of the cycle of operation. FIG. 3 illustrates an embodiment of the dispensing system of the washing machine 10 in which the treating chemistry is supplied to a flow of water that is being supplied to the tub 14 through the tub outlet conduit 54. The dispenser 62 may be coupled with the tub outlet conduit 54 through a transfer line 110 by a venturi 112 through which treating chemistry may be metered under pressure into the flow of water in the tub outlet conduit 54. The treating chemistry mixed with water is then supplied to the tub 14. The dispenser 62 may be provided with a dispensing pump 114 to pump the treating chemistry from the dispenser 62 into the transfer line 110 for delivery to the tub outlet conduit 54 by the venturi 112. The dispensing pump 114 may be any suitable type of pump, such as a bellows pump or a positive displacement pump, for example. The dispensing pump 114 may be controlled by the controller 96 to operate according to a duty cycle to control the amount and timing of the treating chemistry dispensed from the dispenser 62. It is also within the scope of the invention for the venturi 112 to be used without a pump 114. For example, the flow of treating chemistry through the transfer line 110 may be controlled by a valve that may be selectively opened and closed by the controller 96 to control the amount and timing of the treating chemistry dispensed from the dispenser 62.

Alternatively, in place of the venturi 112, an in-line mixing chamber, such as that disclosed in application Ser. No. 13/093,132, filed Apr. 25, 2011, entitled "Method and Apparatus for Dispensing Treating Chemistry in a Laundry Treating Appliance," now U.S. Pat. No. 8,438,881, issued May 14, 2013, which is incorporated herein by reference in full, may also be provided.

FIG. 4 illustrates an embodiment of the dispensing system of the washing machine 10 in which the dispenser 62 further comprises a mixing chamber 116. A predetermined amount of treating chemistry may be provided to the mixing chamber 116 according to any suitable means, (not shown), such as through a syringe pump or the dispensing pump 114 of FIG. 3. Water supplied to the dispenser 62 through the dispensing supply conduit 68 may be mixed with the treating chemistry in the mixing chamber 116 to dilute the treating chemistry prior to dispensing the treating chemistry to the treating chamber 18 through the dispensing outlet conduit 64. The mixing may occur in any suitable manner, such as by supplying the water to the mixing chamber 116 under pressure, agitating the treating chemistry and water in the mixing chamber 116 (e.g. stirring) or vibrating the mixing chamber 116. The diluted treating chemistry may be supplied directly to the treating chamber 18, such as through the dispensing spray nozzle 66, for example. Alternatively, the diluted treating chemistry may be supplied from the mixing chamber 116 to a flow of water that is delivered to the treating chamber 18, such as illustrated in FIG. 3.

The previously described washing machine 10 may be used to implement one or more embodiments of the invention. The embodiments of the method of the invention may be used to control the operation of the washing machine 10 to complete a cycle of operation in which the dispensing system is controlled to dispense a treating chemistry based on a determined amount of laundry in the washing machine 10.

Figure 5:
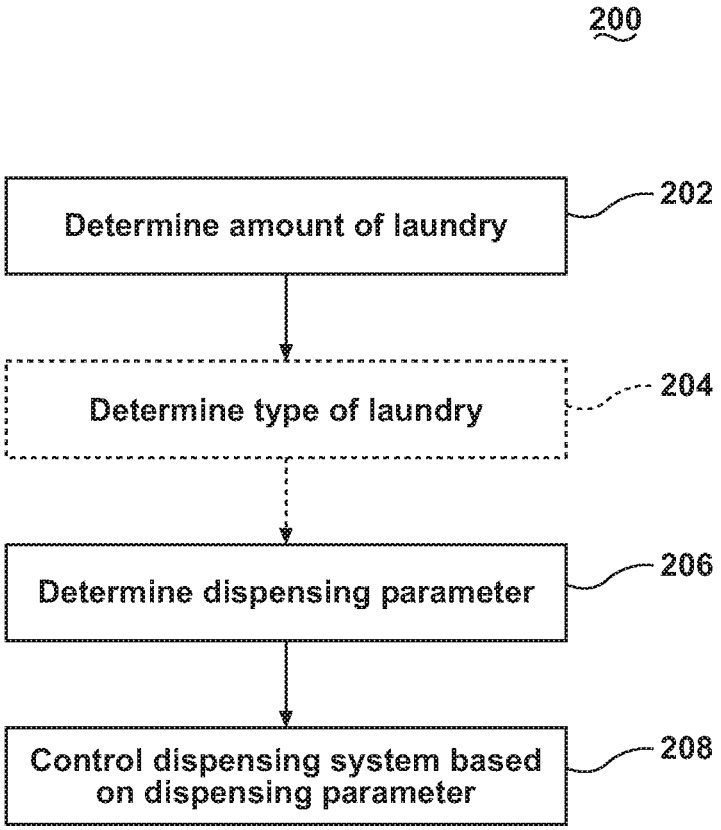
FIG. 5 is a flow chart illustrating a method of operating a laundry treating appliance to dispense a treating chemistry according to a fourth embodiment of the invention.

Referring now to FIG. 5, a flow chart of a method 200 for controlling the dispensing system based on the amount of laundry in the washing machine 10 is illustrated. The sequence of steps depicted for this method and the proceeding methods are for illustrative purposes only, and is not meant to limit any of the methods in any way as it is understood that the steps may proceed in a different logical order or additional or intervening steps may be included without detracting from the invention.

The method 200 starts with assuming that the user has placed one or more laundry articles for treatment within the treating chamber 18 and selected a cycle of operation through the user interface 98 that includes at least one addition of at least one treating chemistry. The method 200 may be implemented during any portion of a cycle of operation or may be implemented as a separate cycle of operation. The cycle of operation may include a water supply phase during which water is supplied to the treating chamber 18 for use with a treating chemistry to treat the laundry according to the cycle of operation. The cycle of operation may also include a load saturation phase during which liquid is supplied to the treating chamber 18 to sufficiently saturate the laundry load. The load saturation phase may be part of the water supply phase or a separate phase. The cycle of operation may also include a dispensing phase during which a treating chemistry is dispensed to the treating chamber 18 for a predetermined period of time corresponding to a dispensing interval. Non-limiting examples of a cycle of operation that includes a treating chemistry includes a pre-wash cycle, a bleach cycle, a wash cycle, a stain treating/removal cycle and an odor removal cycle. As used herein, supplying material to the treating chamber 18, such as water or a treating chemistry, may include supplying material to the tub 14 and/or the drum 16. Material may be supplied to directly to the drum 16 or indirectly to the drum 16, such as through the tub 14.

At 202, the amount of laundry in the treating chamber 18 is determined. The amount of laundry may be qualitative or quantitative and may be determined manually based on user input through the user interface 98 or automatically by the washing machine 10. For example, a qualitative determination of the laundry amount may include determining whether the laundry is a small, medium or large load. A quantitative determination may include determining a weight or volume of the laundry within the treating chamber 18. The amount of laundry may be determined automatically in any suitable manner, such as using a weight sensor, or based on sensor output from the motor 88, as discussed previously. The manner in which the amount of laundry is determined is not germane to the embodiments of the invention.

At 104, the type of laundry may optionally be determined manually based on user input through the user interface 98 or automatically by the washing machine 10. Non-limiting examples of types of laundry include cotton, silk, polyester, delicates, permanent press and heavy duty. In one example, the controller 96 may determine the type of laundry based on the cycle of operation selected by the user. Alternatively, one or more sensors may be used to determine the type of laundry. The manner in which the type of laundry is determined is not germane to the embodiments of the invention.

At 206, the controller 96 may determine a dispensing parameter for at least one treating chemistry to be dispensed during the cycle of operation based on the amount of laundry determined at 202 and optionally the type of laundry determined at 204. The dispensing parameter may be defined by a dilution of a treating chemistry and/or a delivery rate of a treating chemistry. When the cycle of operation includes dispensing more than one treating chemistry, a dispensing parameter for each treating chemistry to be dispensed may be determined based on the amount of laundry and optionally the type of laundry determined at 204 and 206, respectively.

The dispensing parameter may be determined empirically or experimentally for a given load based on the amount of laundry determined at 202. Additional parameters, such as the flow rate of the water supply as determined by the flow meter 58, the flow rate of the dispensing pump 114, the length of the dispensing interval, the amount of treating chemistry to supply to the treating chamber 18 and the amount of water to supply to the treating chamber 18, may also be used to determine the dispensing parameter based on the determined amount of laundry.

At 208, the controller 96 may control the dispensing system to dispense at least one treating chemistry during the cycle of operation based on the dispensing parameter determined at 206 for the at least one treating chemistry. When the cycle of operation includes dispensing more than one treating chemistry, each treating chemistry may be dispensed according to its respective dispensing parameter at the appropriate timing according to the cycle of operation. The controller 96 may control the dispensing system to dispense the treating chemistry according to the dilution and/or delivery rate defined by the dispensing parameter determined at 206.

Controlling the dispensing system may include controlling the dispensing pump 114 according to a duty cycle to dispense the treating chemistry according to the determined dispensing parameter. During the ON portions of the duty cycle, the dispensing pump 114 may dispense the treating chemistry according to a known rate. The dispensing pump may be turned ON and OFF according to a duty cycle set based on the determined dispensing parameter to dispense a predetermined amount of treating chemistry over a predetermined dispensing interval.

Controlling the dispensing system may also include controlling the pattern of supply of the treating chemistry to the treating chamber 18. The treating chemistry may be dispensed such that the delivery rate is constant throughout the water supply phase or the treating chemistry may be dispensed intermittently throughout the water supply phase.

When the load saturation phase is part of the water supply phase, the load may be saturated with liquid containing the treating chemistry. Alternatively, the load saturation phase may occur prior to the water supply phase such that the load is sufficiently saturated with water prior to the water supply phase. The treating chemistry may be dispensed intermittently at the delivery rate determined at 206 or the treating chemistry may be dispensed at two or more intermittent delivery rates, with the average of the intermittent delivery rates corresponding to the delivery rate. In one example, the pattern of supply may be controlled by operating the dispensing pump 114 according to a duty cycle in which the ON and OFF times of the dispensing pump 114 supply an amount of treating chemistry at a delivery rate determined according to the dispensing parameter throughout the length of the dispensing interval.

Some treating chemistries, such as enzymes, bleaches, oxidizing agents, inhibitors, activators and deactivators, for example, may have a limited useful life cycle in the treating chamber 18 during which the effectiveness of the treating chemistry is within a predetermined acceptable range. Properties such as the dilution of the treating chemistry, the temperature of the liquid and the pH of the liquid in the treating chamber 18, all of which may be effected by the amount of liquid in the treating chamber 18 and the presence of additional treating chemistries, may effect the useful life cycle of the treating chemistry. In addition, the amount of liquid present in the treating chamber 18, the degree of saturation of the laundry and the stage of the treatment cycle when the treating chemistry is dispensed may effect the degree to which the treating chemistry distributes throughout the laundry load. As used herein, the amount of liquid in the treating chamber 18 may refer to the amount of free liquid located within the tub 14 and/or drum 16 and/or the amount of liquid carried by the laundry load.

For example, if the treating chemistry is supplied all at once to the treating chamber 18 in a single shot at the beginning of the treatment phase of a cycle, it may concentrate or pool on the laundry fabric the treating chemistry initially contacts without dispersing to the remainder of the laundry load. In addition, the amount of liquid present in the treating chamber 18 and/or the saturation of the laundry load may be low at the beginning of the treatment phase, further inhibiting the distribution of the treating chemistry. If the treating chemistry is applied near the end of the treatment phase, when the amount of liquid and the saturation of the laundry load within the treating chamber 18 are higher, there may not be enough time remaining in the treatment phase to take advantage of the useful life cycle of the treating chemistry before the cycle moves to the next phase.

Controlling the pattern of supply of the treating chemistry allows for less chemistry to be used to provide for the same or improved treatment performance compared to applying the treating chemistry in a single shot. In addition, the pattern of supply of the treating chemistry may be controlled taking into account factors such as the amount of liquid in the treating chamber 18, the saturation of the laundry, properties of the treating chamber 18 (e.g temperature, pH), the presence of other treating chemistries and the timing the of the cycle of operation to more efficiently utilize the useful life cycle of the treating chemistry.

For example, dispensing aliquots of the treating chemistry intermittently throughout the dispensing interval may provide for improved distribution of the treating chemistry throughout the laundry load, as each aliquot is likely to initially contact a different portion of the laundry load. In addition, dispensing one aliquot at a time allows for at least some mixing of the treating chemistry in the first aliquot with the liquid in the treating chamber 18 before the next aliquot is dispensed. Some types of treating chemistries, such as detergents, for example, are not highly soluble in water and may also have a high viscosity, making it difficult to evenly distribute the treating chemistry throughout the liquid and laundry within the treating chamber 18. Providing the treating chemistry to the liquid within the chamber in smaller aliquots may allow for more adequate mixing and distribution of water insoluble and/or viscous treating chemistries in the liquid within the treating chamber 18.

The treating chemistry may also be dispensed intermittently so as to roughly correspond with a decrease in the effectiveness of the treating chemistry in the previously dispensed aliquot. For example, depending on the properties of the treating chamber 18, such as the temperature or pH, the useful life cycle of an enzyme may have a limited duration and thus the overall effectiveness of the enzyme will be limited. The enzyme may be dispensed intermittently, roughly corresponding to the useful life cycle of the enzyme, to maintain the effectiveness of the enzyme at a constant level for a longer duration during the treatment cycle.

Similarly, dispensing the treating chemistry constantly throughout the dispensing interval may provide for improved mixing and distribution of the treating chemistry through the liquid and laundry in the treating chamber 18. Dispensing the treating chemistry constantly throughout the dispensing interval essentially results in a slow addition of the treating chemistry spread out over a longer period of time compared to dispensing a single shot of treating chemistry at one time during the cycle. The slow addition of the treating chemistry may allow for more adequate mixing and distribution of the treating chemistry as it is being added before the full amount of treating chemistry has been dispensed. In addition, dispensing the treating chemistry constantly throughout the dispensing interval may facilitate maintaining the effectiveness of certain treating chemistries at a constant level throughout the dispensing interval. For example, treating chemistries such as enzymes, bleaches, activators, oxidizing agents, inhibitors and deactivators may have a limited useful life cycle depending on the properties of the treating chamber 18. Dispensing the treating chemistry throughout the dispensing interval may provide for a more constant level of activity of these types of treating chemistries.

The treating chemistry may be added directly to the treating chamber 18 and diluted with water in the treating chamber 18 or the treating chemistry may be diluted with water prior to being supplied to the treating chamber 18. For example, the treating chemistry may be diluted with water in the mixing chamber 116 of FIG. 4 and then supplied to the treating chamber 18. In another example, the treating chemistry may be diluted by supplying the treating chemistry directly into a flow of water through the venturi 112 that is then supplied to the treating chamber 18, as illustrated in FIG. 3.

It has been determined that a performance improvement in treating the laundry may occur when the rate of treating chemistry deposition on the laundry is between 0.75 milliliters (mL) of treating chemistry per 1 Liter (L) of water and 10 mL of treating chemistry per 1 L of water. The dispensing parameter may be determined at 106 to achieve the desired rate of deposition on the laundry based on the amount of laundry determined at 102. The rate of treating chemistry deposition can be set by changing the speed of the dispensing pump 114, adjusting the duty cycle of the dispensing pump 114 or changing the flow rate of the water supplied to the dispenser 62 and/or the treating chamber 18.

In one example, the amount of laundry determined at 202 may be used by the controller 96 at 206 to determine an amount of water to supply to the treating chamber 18 during a water supply phase and an amount of treating chemistry to supply to the treating chamber 18 for use with the water supplied during the water supply phase to treat the laundry in the treating chamber 18. The controller 96 may then determine the dispensing parameter based on the amount of water and the amount of treating chemistry to obtain a desired rate of treating chemistry deposition on the laundry. At 208 the controller 96 may control the components of the dispensing system according to the determined dispensing parameter.

Figure 6:
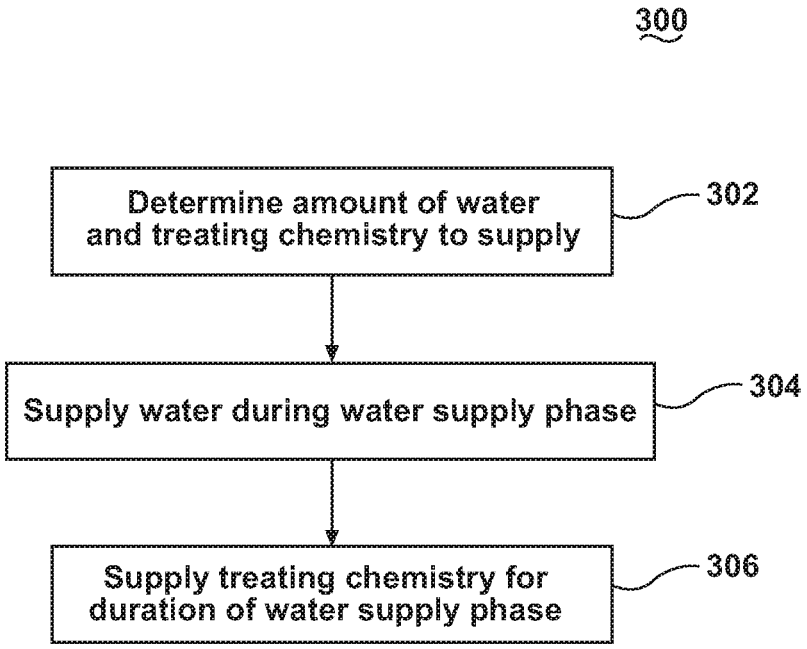
FIG. 6 is a flow chart illustrating a method of operating a laundry treating appliance to dispense a treating chemistry according to a fifth embodiment of the invention.

Referring now to FIG. 6, a flow chart of a method 300 for controlling the dispensing system to dispense a treating chemistry for the entire duration of a water supply phase during a cycle of operation is illustrated. The method 300 may be used alone or in combination with the method 200 of FIG. 5.

The method 300 starts with assuming that the user has placed one or more laundry articles for treatment within the treating chamber 18 and selected a cycle of operation through the user interface 98 that includes at least one addition of at least one treating chemistry. The method 300 may be implemented during any portion of a cycle of operation or may be implemented as a separate cycle of operation. Non-limiting examples of a cycle of operation that includes a treating chemistry includes a pre-wash cycle, a bleach cycle, a wash cycle, a stain treating/removal cycle and an odor removal cycle.

At 302, the amount of water to supply during a water supply phase of the cycle of operation and an amount of treating chemistry to supply for use with the water to treat the laundry may be determined. The amount of water and treating chemistry to supply may be determined according to the cycle of operation and other parameters set by the user or determined based on the amount and type of laundry determined at 202 and 204 of the method 200 of FIG. 5.

At 304, the liquid supply system may be controlled by the controller 96 to supply water to the treating chamber 18 according to the water supply phase of the selected cycle of operation. The duration of the water supply phase may depend on the flow rate of water through the supply conduit 52 and the amount of water to supply to the treating chamber 18 as determined at 302. The flow rate of water through the supply conduit 52 may be determined by the flow meter 58. Alternatively, the flow rate of water may be set according to the average flow rate of water from a typical household water supply.

At 306, the controller 96 may control the dispensing system to dispense the treating chemistry for the duration of the water supply phase at 304. The dilution and/or the delivery rate of the treating chemistry may be determined according to 206 of the method 200 of FIG. 5 or according to the selected cycle of operation. The pattern of dispensing the treating chemistry may also be controlled as discussed above for method 200 of FIG. 5 to dispense the treating chemistry at a constant rate for the duration of the water supply phase or intermittently for the duration of the water supply phase. The treating chemistry may be dispensed such that the total amount of treating chemistry dispensed at the end of the water supply phase corresponds to the total amount of treating chemistry to be dispensed according to the amount/type of laundry and/or the cycle of operation.

For example, the total amount of water supplied to the treating chamber 18 during the water supply phase can range from approximately 2 L up to 30 L. The controller 96 may control the dispensing system to dispense the treating chemistry at a rate ranging from approximately 0.75 mL per liter of water to 10 mL per liter of water during the water supply phase. The total amount of water and treating chemistry supplied to the treating chamber 18 during the water supply phase may vary depending on variables such as the cycle of operation and one or more settings within the cycle of operation, such as fabric type, soil level and load size, for example.

In a typical washing machine, a large amount of treating chemistry, such as a detergent, is supplied to the laundry during a cycle of operation. When a large amount of detergent falls onto a 3-dimensional article, such as one or more layers of fabric of a laundry item, the detergent may pool within the voids of the fabric and coat the surfaces of the fabric. The pooling and coating of the detergent may result in the detergent attaching to the fabric in tightly localized areas, inhibiting mixing of the detergent with the remainder of the laundry load. Mixing of the detergent with the laundry load may further be inhibited for short cycles or for cold water cycles. The inhibition of mixing of the detergent may result in a decrease in the performance of the cycle of operation. A larger amount of detergent may be added to attempt to compensate for the decrease in performance; however, the use of additional detergent is costly and inefficient.

The embodiments of the invention described herein provide methods for dispensing a treating chemistry to decrease the pooling and coating of the treating chemistry that may inhibit mixing of the treating chemistry with the laundry load. The embodiments of the invention provide for dispensing a treating chemistry based on an amount and optionally type of laundry in the treating chamber. The disclosed methods provide for the use of less and/or more efficient use of treating chemistry while still maintaining the same or improved level of performance. The pattern of dispensing the treating chemistry may also result in a decrease in the inhibition of mixing of the treating chemistry, resulting in a corresponding need for less treating chemistry to achieve the same level of performance. The pattern of dispensing may also provide for more efficient use of the treating chemistry, which may allow for the use of less treating chemistry to provide the same or improved level of performance.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a treating chamber configured for receiving laundry for treatment;

a dispensing system adapted to dispense a treating chemistry to the treating chamber; and a controller configured to determine an amount of laundry in the treating chamber, determine a dispensing parameter based on the determined amount wherein the dispensing parameter is defined by one or more of a delivery rate of the treating chemistry, a dilution rate of the treating chemistry, a flow rate of a water supply, a flow rate of a dispensing pump, or a length of a dispensing interval and operate the dispensing system in accordance with the determined dispensing parameter.

2. The laundry treating appliance of claim 1, further comprising a laundry amount sensor operably coupled to the controller, the laundry amount sensor outputting an amount signal indicative of the amount of laundry in the treating chamber.

3. The laundry treating appliance of claim 2, further comprising a drum rotatably mounted within a tub with at least one of the tub or the drum defining the treating chamber.

4. The laundry treating appliance of claim 3 wherein the laundry amount sensor comprises a motor configured to selectively rotate the drum and wherein the motor is operably coupled with the controller and the motor is configured to output a torque signal indicative of the amount of laundry in the drum to the controller.

5. The laundry treating appliance of claim 1, further comprising a laundry type sensor outputting a laundry type signal indicative of a type of laundry in the treating chamber and wherein the dispensing parameter is determined by the amount of laundry and the type of laundry.

6. The laundry treating appliance of claim 1 wherein the dispensing system includes a dispensing pump operably coupled to the controller and adapted for dispensing the treating chemistry.

7. The laundry treating appliance of claim 6 wherein the controller is configured to control a flow rate of the treating chemistry based on the amount of laundry and a dilution of the treating chemistry.

8. The laundry treating appliance of claim 7, further comprising a liquid supply system operable to fluidly couple the treating chamber with a water supply.

9. The laundry treating appliance of claim 8 wherein the dispensing system further comprises a mixing chamber fluidly coupled with the liquid supply system and an output of the dispensing pump for mixing the treating chemistry with water.

10. The laundry treating appliance of claim 8 wherein the dispensing system is fluidly coupled with the liquid supply system and wherein the treating chemistry is dispensed via the dispensing pump into the liquid supply system.

11. The laundry treating appliance of claim 8 wherein the controller is configured to control the liquid supply system to supply water to the treating chamber and further configured to control the dispensing system to dispense the treating chemistry at the flow rate for a duration of the supply of water.

12. The laundry treating appliance of claim 1, further comprising a liquid supply system operable to fluidly couple the treating chamber with a water supply.

13. The laundry treating appliance of claim 12 wherein the controller is configured to control the liquid supply system to supply water to the treating chamber and further configured to control the dispensing system to dispense the treating chemistry at the flow rate for a duration of the supply of water.

14. The laundry treating appliance of claim 1, further comprising a user interface operably coupled to the controller, the user interface configured to output a laundry amount indication to the controller.

15. The laundry treating appliance of claim 14 wherein the user interface further comprises a cycle selector and outputting the laundry amount indication comprises outputting a user selected cycle.

16. The laundry treating appliance of claim 14 wherein the user interface further comprises a parameter selector and outputting the laundry amount indication comprises outputting a user selected parameter selection.

17. The laundry treating appliance of claim 1, further comprising a mixing chamber fluidly located between the dispensing system and the treating chamber and wherein dispensing the treating chemistry comprises supplying the treating chemistry into the mixing chamber.

18. The laundry treating appliance of claim 17, further comprising a water supply system configured to supply water to at least one of the treating chamber, the dispensing system, or the mixing chamber.

19. The laundry treating appliance of claim 18, further comprising a flow meter operably coupled to the water supply system and configured to output a signal to the controller indicative of the flow rate of a flow of water within the water supply system.

20. The laundry treating appliance of claim 19 wherein the controller is further configured to determine the dispensing parameter based on a signal output by the flow meter.

* * * * *